US007228701B2

(12) United States Patent
Kim

(10) Patent No.: US 7,228,701 B2
(45) Date of Patent: Jun. 12, 2007

(54) REFRIGERATOR

(75) Inventor: Ill-Shin Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 53 days.

(21) Appl. No.: 10/513,503

(22) PCT Filed: May 27, 2003

(86) PCT No.: PCT/KR03/01031

§ 371 (c)(1),
(2), (4) Date: Nov. 5, 2004

(87) PCT Pub. No.: WO03/102481

PCT Pub. Date: Dec. 11, 2003

(65) Prior Publication Data

US 2005/0229623 A1 Oct. 20, 2005

(30) Foreign Application Priority Data

May 31, 2002 (KR) ..... 10-2002-0030709

(51) Int. Cl.
*F25D 23/12* (2006.01)

(52) U.S. Cl. ..... 62/338; 62/391; 210/184; 222/189.06

(58) Field of Classification Search ..... 62/337–356, 62/389, 391; 222/189.06; 210/110, 175, 210/184, 186
See application file for complete search history.

(56) References Cited

U.S. PATENT DOCUMENTS 5,135,645 A * 8/1992 Sklenak et al. ..... 210/97
5,211,462 A 5/1993 Bien et al. ..... 312/404
5,715,699 A * 2/1998 Coates et al. ..... 62/338
6,079,221 A * 6/2000 Senner ..... 62/338
6,148,624 A * 11/2000 Bishop et al. ..... 62/137
6,337,015 B1 * 1/2002 Poirier ..... 210/232
6,574,984 B1 * 6/2003 McCrea et al. ..... 62/449
6,904,765 B2 * 6/2005 Lee et al. ..... 62/320

FOREIGN PATENT DOCUMENTS

JP 10-132456 5/1998
KR 10-1999-18051 3/1999
KR 20-2001-40812 12/2001

* cited by examiner

*Primary Examiner*—William E. Tapolcai
(74) *Attorney, Agent, or Firm*—Ked & Associates, LLP

(57) ABSTRACT

A refrigerator is provided which includes an ice maker, a dispenser and the other related components installed to a refrigerator door that opens and closes a storage space of a main body of the refrigerator, the walls of which are formed of insulating layers. A water supply tube is provided in the door to pass through a lower hinge and extend through the door so that water can be supplied to a filter in a filter chamber defined within the door. The water purified in the filter is supplied through a valve to the ice maker and dispenser. The filter chamber is configured to be opened and closed by a service door so that a user can more easily exchange the filter. The service door is provided in front of the door. Since the ice maker, the dispenser and the related components are integrated within the door, the storage space defined by the main body of the refrigerator can be further increased. In addition, a function of the refrigerator can also be improved by merely exchanging the door rather than the whole refrigerator.

36 Claims, 6 Drawing Sheets

REFRIGERATOR

BACKGROUND OF THE INVENTION

1. Field of the Invention

The present invention relates to a refrigerator, and more particularly, to a refrigerator with a dispenser, an ice maker and the like.

2. Description of the Prior Art

Most large refrigerators recently on the market are provided with a dispenser by which ice or water contained therein can be dispensed without opening a refrigerator door. Therefore, the dispenser can prevent cold air within the refrigerator from escaping to the outside and provide users with more convenience. The refrigerator constructed as such is disclosed in U.S. Pat. No. 6,082,130.

FIG. 1 is a perspective view schematically showing a configuration of a conventional refrigerator with an ice maker and a dispenser, as disclosed in the '130 patent. Referring to the figure, water that has flowed from the outside into the refrigerator through a connection tube D1 passes through and is purified in a filter 1 mounted to a main body 0 of the refrigerator. Then, the water is supplied or introduced to either an ice maker 2 for making ice or a storage tank 3 for storing the purified water. A water supply valve 4 is installed between the filter 1 and the ice maker/water storage tank 2, 3 so as to regulate an amount of water to be supplied to the ice maker 2 or storage tank 3.

The ice maker 2 and the water storage tank 3 are connected to a dispenser 6 installed in a refrigerator door 5, through connection tubes D3, D2, respectively. The stored water and ice are supplied to the dispenser 6 through the connection tubes D2, D3, respectively. Then, a user can eat and drink the ice and water discharged from a dispenser 6 through a dispensing port (not shown). In the '130 patent, the ice maker 2 may also be installed to the main body 0 adjacent to the dispenser 6 so that the ice can be directly supplied to the dispenser 6 without using the connection tube D3.

However, there are the following problems in the prior art.

First of all, only the dispenser 6 is mounted to the refrigerator door 5 and most other components related to the dispenser 6 are mounted in the main body 0 of the refrigerator. For example, the components such as the ice maker 2, the water storage tank 3, and the filter 1 used for purifying water supplied to the dispenser and ice maker 6, 2 are arranged in the main body 0 of the refrigerator. Thus, there is a problem in that a refrigerator manufactured with the above components not included therein cannot be upgraded for use in such a dispenser function.

Further, since the components related to the dispenser 6 are spaced apart from the dispenser 6, additional components are needed for transferring the water or ice between the dispenser-related components. Therefore, there is another problem in that more interior space in the refrigerator is allocated for the additional components and the interior configuration thereof is also complicated.

Furthermore, since the filter 1 of the refrigerator is generally mounted on a rear surface or in a rear portion of the main body 0 of the refrigerator, it is difficult to exchange the filter.

SUMMARY OF THE INVENTION

The present invention is conceived to solve the aforementioned problems. An object of the present invention is to provide a refrigerator door capable of easily adding a dispenser function to a refrigerator, and a refrigerator using the refrigerator door.

Another object of the present invention is to provide a refrigerator wherein a configuration needed for connecting components related to a dispenser can be simplified by installing all the components within a refrigerator door.

A further object of the present invention is to provide a refrigerator wherein a filter used in the refrigerator can be easily exchanged.

According to an aspect of the present invention for achieving the objects, there is provided a refrigerator which comprises a main body with a storage space defined thereby, a door installed to the main body of the refrigerator for selectively opening and closing the storage space, a water filter mounted in the door for purifying water supplied from the outside of the main body of the refrigerator, a dispenser formed in front of the door for discharging the water purified in the filter to the outside of the main body of the refrigerator, and an ice maker mounted in the door for making the water into ice.

According to another aspect of the present invention for achieving the objects, there is provided a refrigerator door for opening and closing a storage space defined by a main body of a refrigerator. The refrigerator door comprises a water filter mounted in the door for purifying water supplied from the outside of the main body of the refrigerator, a dispenser for discharging the water purified in the filter to the outside of the refrigerator through an exterior surface of the door, and an ice maker mounted in the door for making the water into ice.

The filter may be supplied with the water from an outside water source through a water supply tube that passes through a door hinge and extends through the door of the refrigerator.

Preferably, the filter is mounted within a filter chamber formed in the door, and a service door is provided in the filter chamber for selectively opening and closing the filter chamber.

More preferably, a motor for driving the ice maker and a valve for regulating water supply to the ice maker and dispenser are further provided in the filter chamber.

The filter chamber may be selectively opened and closed by a water basin that is provided below the dispenser.

Preferably, a water supply tank in which heat exchange with cold air in the storage space is made is further provided in a supply tube to the dispenser through which the water purified in the filter is supplied to the dispenser.

A cutoff means for cutting off the water flowing toward the filter upon exchange of the filter may be further provided at a water supply tube through which the water is supplied from the outside source to the filter.

According to the present invention constructed as such, since the dispenser, the ice maker and the related components are all installed within the door, the functions of the dispenser and the ice maker can be added to the conventional refrigerator by merely exchanging a conventional door for the door with the dispenser and ice maker. Therefore, the productivity improvement and function upgrade can be made through common use of the main body of the refrigerator.

BRIEF DESCRIPTION OF THE DRAWINGS

The above and other objects and features of the present invention will become apparent from the following description of preferred embodiments given in conjunction with the accompanying drawings, in which:

FIG. 1 is a rear perspective view schematically showing a configuration of a conventional refrigerator with a dispenser, an ice maker and the like;

DESCRIPTION OF THE PREFERRED EMBODIMENTS

Hereinafter, preferred embodiments of a refrigerator according to the present invention will be explained in detail with reference to the accompanying drawings.

Figure 1:
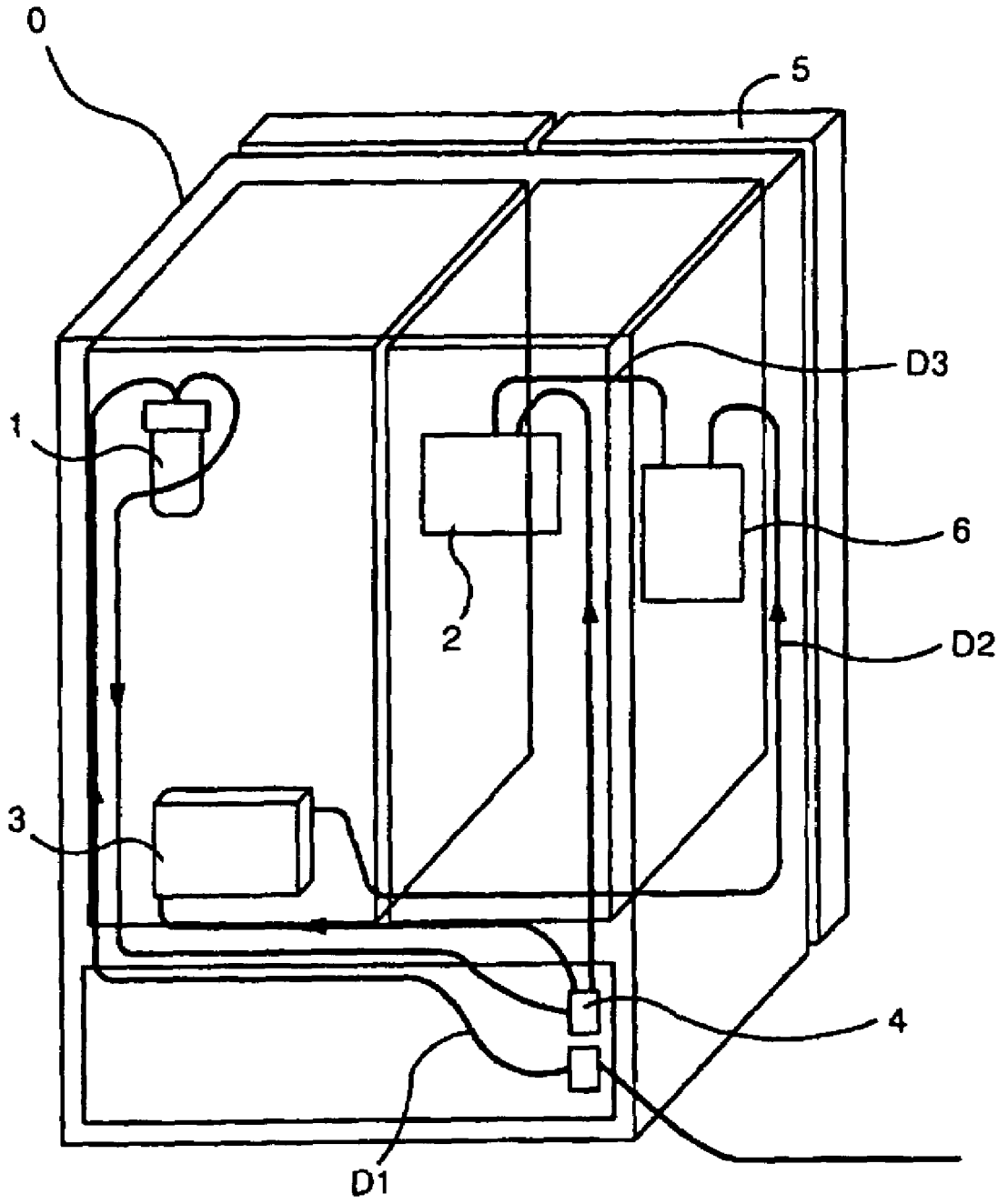
Figure 2:
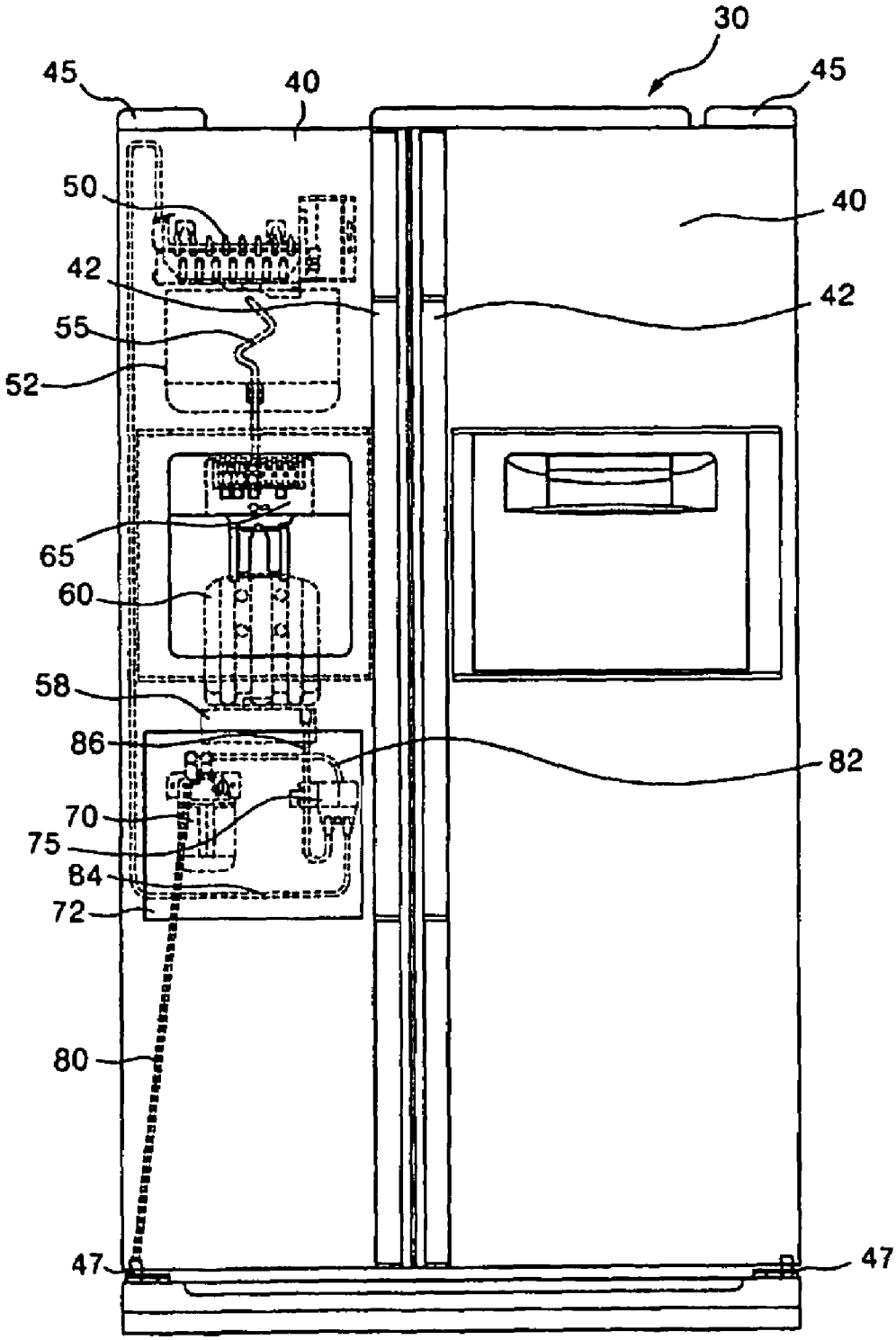
FIG. 2 is a front view of a preferred embodiment of a refrigerator according to the present invention.
Figure 3:
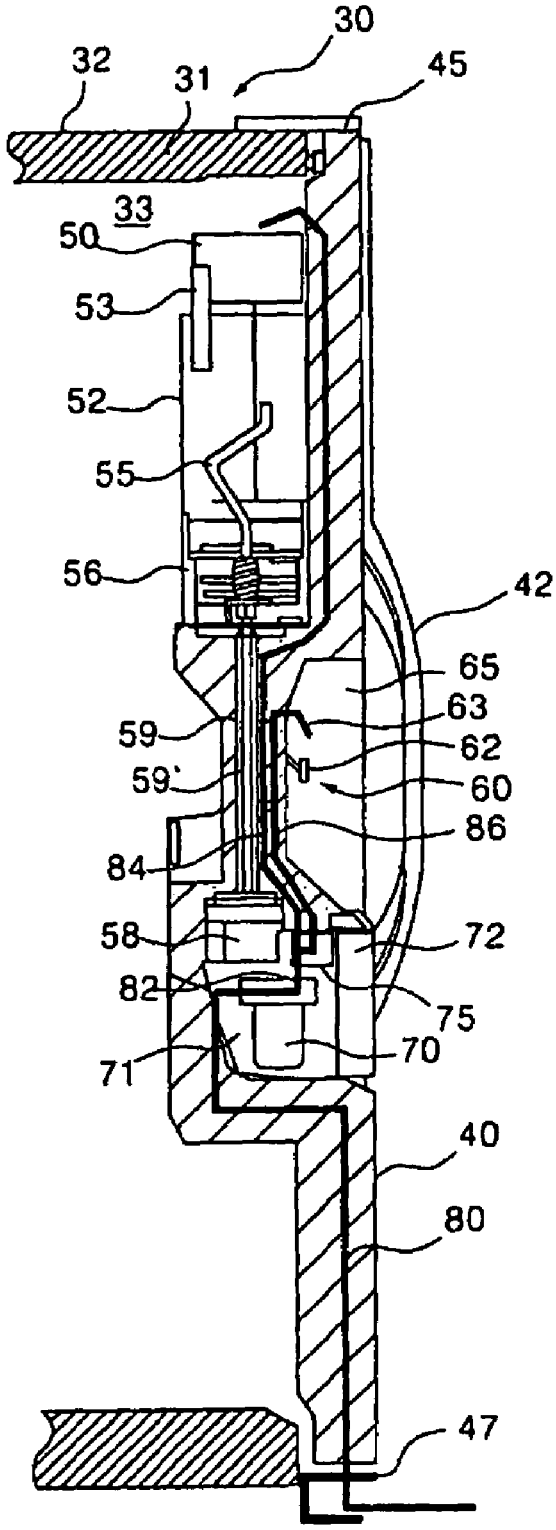
FIG. 3 is a sectional view of a preferred embodiment of a refrigerator according to the present invention.

FIG. 2 is a front view of a refrigerator according to a preferred embodiment of the present invention, and FIG. 3 is a sectional view of the refrigerator according to the present invention.

Referring to the figures, a refrigerator 30 according to a preferred embodiment of the present invention is provided with a storage space 33 within a main body 32 of the refrigerator of which walls are formed of insulating layers 31. In the embodiment of the present invention, two storage spaces 33 are generally formed such that they can be opened and closed by doors 40, 40', respectively.

Door handles 42 are installed to the doors 40, 40', respectively. Upper and lower hinges 45, 47, which serve as pivot centers for the opening and closing of the doors 40, 40', are provided at upper and lower ends of the doors 40, 40', respectively.

In the meantime, one of the doors 40, preferably a freezing chamber door, is provided with an ice maker 50, a dispenser 60, a water filter 70, and the like. First, the ice maker 50 is disposed at an upper portion of an interior side of the door 40 for making water supplied thereto into ice. An ice storage bin 52 is installed below the ice maker 50 for storing the ice made in the ice maker 50. A sensor 53 is disposed at a top portion of the ice storage bin 52 for detecting an amount of ice stored in the ice storage bin 52. Since the configuration and operation of the sensor 53 is common, a detailed description thereof will be omitted.

An ice moving mechanism 55 capable of moving the ice is provided in the ice storage bin 52, and an ice crusher 56 is installed below the ice moving mechanism 55 and coaxially with an axis of rotation thereof. The ice moving mechanism 55 is formed by helically bending a wire and functions to move the ice. The ice crusher 56 functions to crush or crack the ice transferred by the ice moving mechanism 55. A motor 58 for driving the ice moving mechanism 55 and ice crusher 56 is arranged above a filter chamber 71 to be described later. Driving power of the motor 58 is transferred to the ice moving mechanism 55 and the ice crusher 56 through a drive shaft 59' that is placed within a conduit 59 installed in the interior of the refrigerator door 40.

A dispenser 60 is exposed to and provided onto a front surface of the refrigerator door 40. The dispenser 60 allows users to eat the ice and drink the cold water without opening the door 40. The dispenser 60 is provided with an opening lever 62 and a discharge port 63. The opening lever 62 is configured to allow the water to be supplied through the discharge port 63 when pressed by a user with a container such as a cup. Furthermore, an ice outlet 65 through which the ice in the ice storage bin 52 is discharge is provided at an upper portion of the dispenser 60. That is, the ice in the ice storage bin 52 is transferred to the container such as a cup of the user through the ice outlet 65.

Meanwhile, a filter 70 is provided within the filter chamber 71 that is defined within the door 40 and below the dispenser 60. The filter 70 functions to purify the water supplied to the ice maker 50 and the dispenser 60. The filter chamber 71 is opened and closed by a service door 72 that is installed on an exterior surface of the door 40. Thus, the users can exchange the filter 70 by opening the service door 72 in front of the door 40. Although the service door 72 is provided on the exterior surface of the refrigerator door 40 as in the preferred embodiment of the present invention, it may be configured to be placed on an interior surface of the door 40. As a result, an external appearance of the door 40 can be more stylish.

Further, a valve 75 is installed within the filter chamber 71. The valve 75 regulates the transfer of water purified in the filter 70 into the ice maker 50 and/or the dispenser 60. Here, the valves 75 may be provided for the ice maker 50 and the dispenser 60, respectively. Furthermore, only one valve with two individually controllable outlets may be provided.

Now, the configuration for supplying water from the outside of the refrigerator 30 to the ice maker 50 and the dispenser 60 will be discussed. A water supply tube 80 is configured to pass through the lower hinge 47. An end of the water supply tube 80 is connected to the outside water source, and the other end thereof is connected to the filter 70. Of course, it may be configured such that a portion of the water supply tube 80, which extends from the lower hinge 47 to the outside of the refrigerator 30, is not seen from the front of the refrigerator 30 and detachably mounted to the lower hinge 47.

A connection tube 82 is provided to supply water purified in the filter 70 to the valve 75. A supply tube 84 to the ice maker and a supply tube 86 to the dispenser are provided in order to supply the water, which is transferred through the connection tube 82 to the valve 75, to the ice maker 50 and the dispenser 60, respectively. The supply tube 84 and the supply tube 86 extend through the insulating layer 31 of the refrigerator door 40. An end of the supply tube 84 is connected to the valve 75, and the other end thereof is connected to the ice maker 50. Further, an end of the supply tube 86 is connected to the valve 75, and the other end thereof is connected to the discharge port 63 of the dispenser 60.

Figure 4:
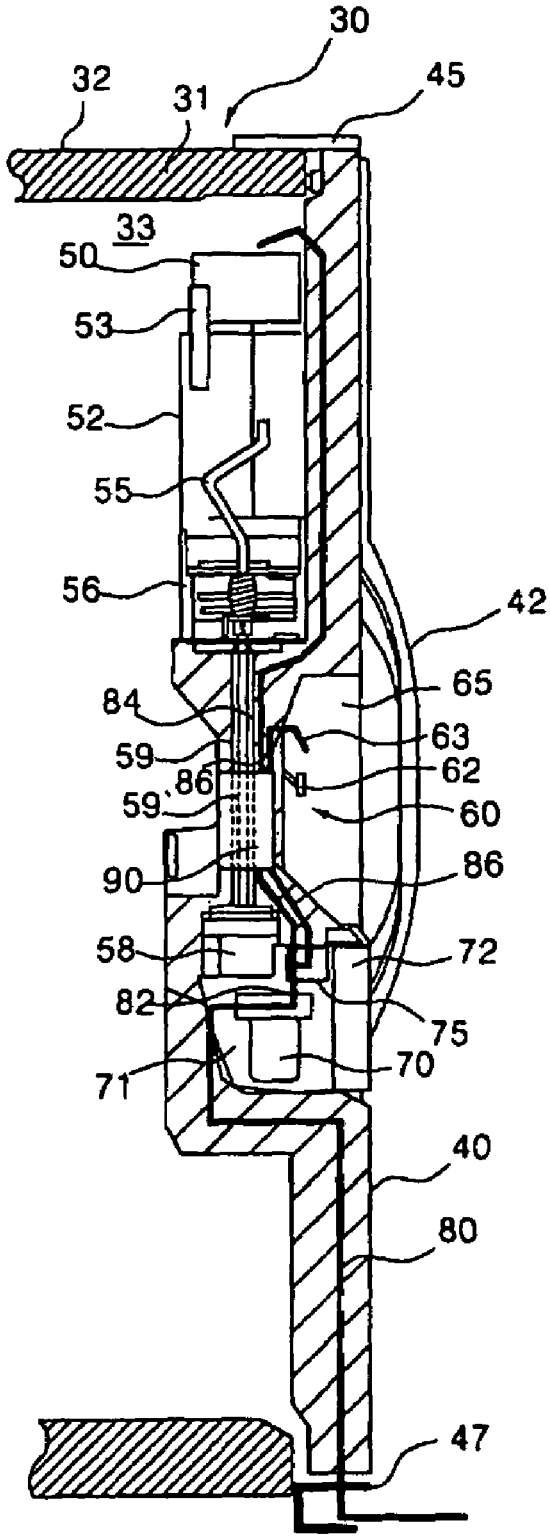
FIG. 4 is a sectional view of another preferred embodiment of a refrigerator according to the present invention.

FIG. 4 shows the configuration of a refrigerator according to another embodiment of the present invention. For simplicity of explanation, the description of the components identical to those of the embodiment shown in FIGS. 2 and 3 will be omitted. In this embodiment, a water supply tank 90 for temporarily storing water to be supplied through the dispenser 60 is further provided. That is, the water supply tank 90 is provided at one side of the supply tube 86 for temporarily storing the water to be transferred to the discharge port 63 of the dispenser 60 through the supply tube 86.

Here, the water supply tank 90 is configured such that the tank is subjected to an influence of the temperature of a storage space 33 which can be accessed by opening and closing the refrigerator door 40. In particular, in a case where the storage space 33 is a freezing chamber, the water in the water supply tank 90 can be kept at a relatively low temperature. Therefore, the user can drink relatively cold water discharged from the dispenser 70.

Figure 5:
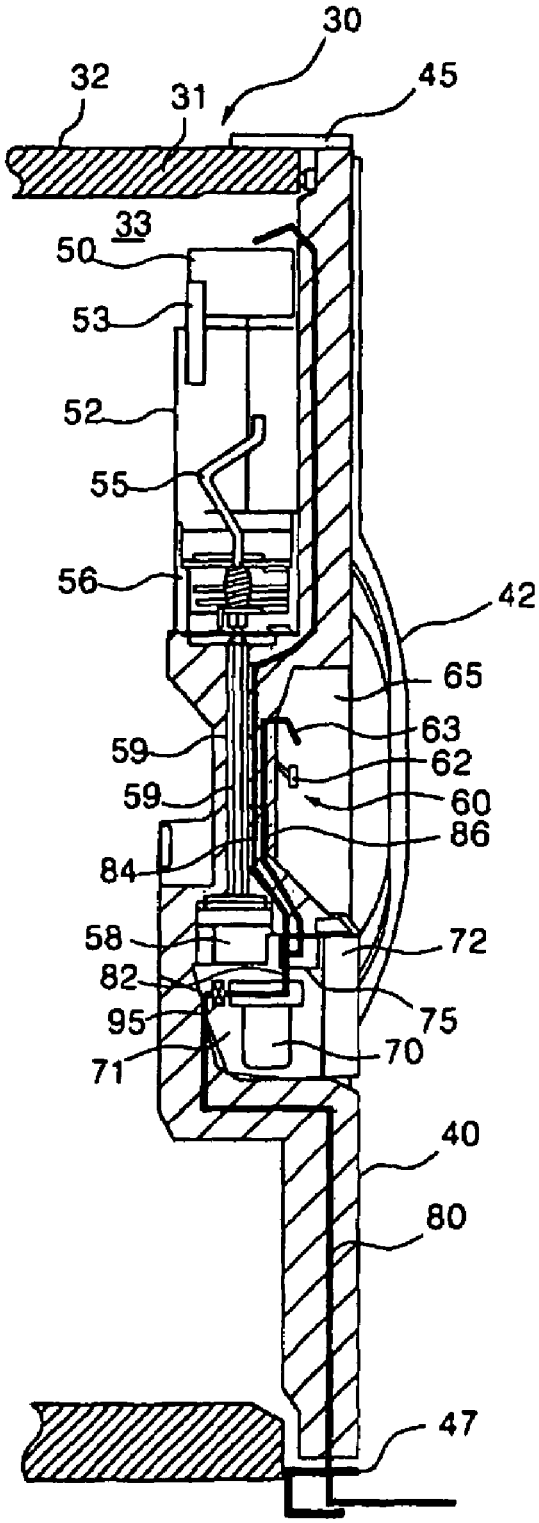
FIG. 5 is a sectional view of a further preferred embodiment of a refrigerator according to the present invention.

FIG. 5 shows the configuration of a refrigerator according to a further embodiment of the present invention. For simplicity of explanation, the description of the components identical to those of the embodiment shown in FIGS. 2 and 3 will also be herein omitted. In this embodiment, a cutoff valve 95 is installed at one side of the water supply tube 80 corresponding to the inlet of the filter 70. The cutoff valve 95 is used to cut off the water flowing through the water supply tube 80 upon exchange of the filter 70. Furthermore, in order to cut off the water flowing the water supply tube 80 upon exchange of the filter 70, a variety of configurations other than the cutoff valve 95 may be employed in the present invention.

Figure 6:
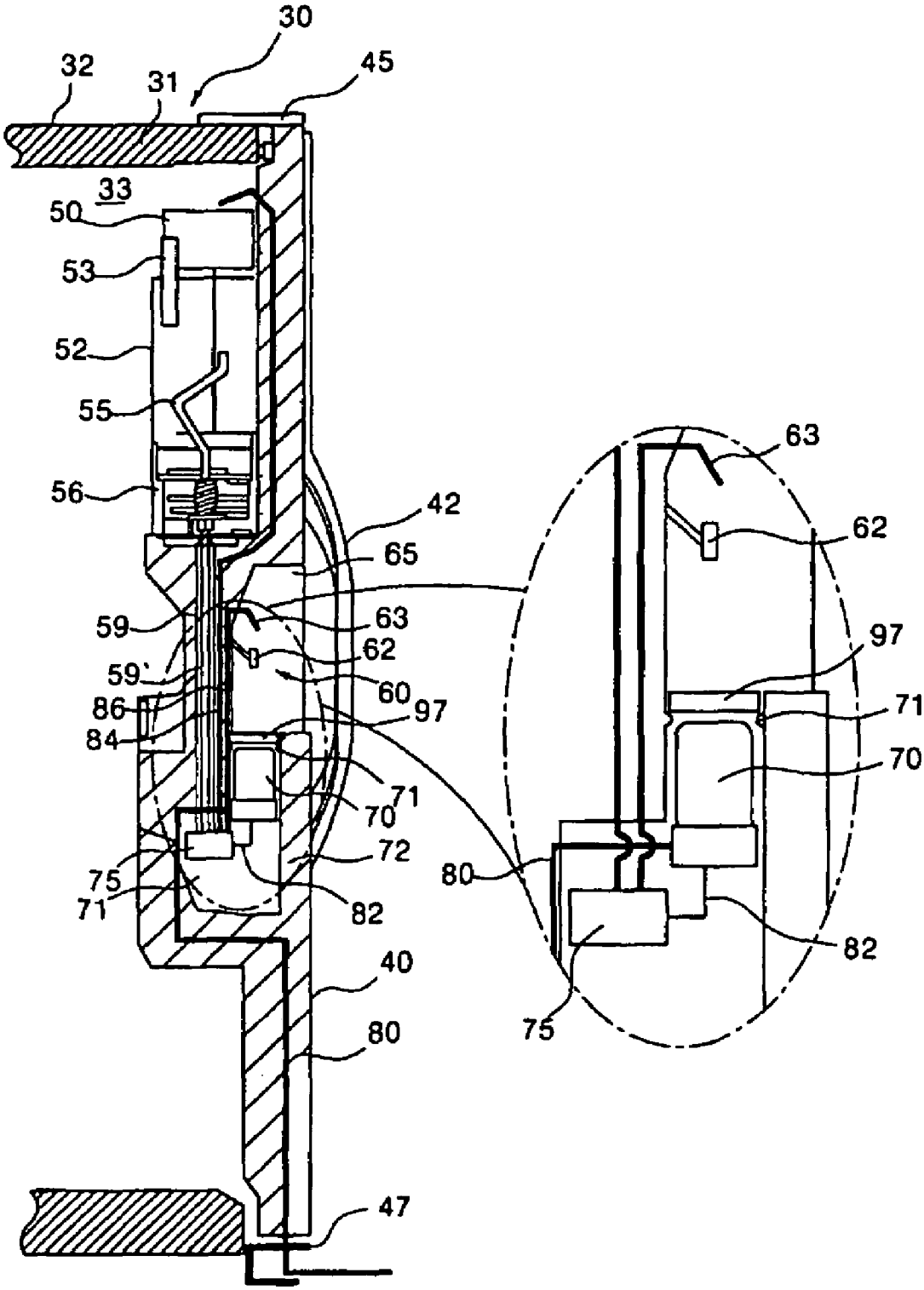
FIG. 6 is a sectional view of a still further preferred embodiment of a refrigerator according to the present invention.

FIG. 6 shows a still further embodiment of the present invention. The configuration of this embodiment different from that shown in FIGS. 2 and 3 will be explained. In this embodiment of the present invention, the service door 72 is not provided on the exterior surface of the door 40. In addition, the filter chamber 71 is formed within the door 40 to be placed below the dispenser 60.

A top portion of the filter chamber 71 is in communication with a bottom portion of the dispenser 60, and a water basin 97 is installed below the dispenser 60. The water basin 97 collects water residue produced from the dispenser 60, and it may also function to selectively close the top portion of the filter chamber 71.

Hereinafter, the configuration and operation of the refrigerator of the present invention constructed as such will be explained in detail.

First, referring to FIGS. 2 and 3, all the components related to the ice maker 50 and the dispenser 60 are installed to the refrigerator door 40. That is, the ice maker 50, the dispenser 60, the filter 70, the valve 75, the water supply tube 80 for the supply of water between the above components, and the like are all provided at the door 40. Therefore, the ice maker 50, the dispenser 60, and the like can be integrated with the door 40, and a single integrated assembly part can be supplied into a main manufacturing line.

Thus, since the ice maker 50, the dispenser 60 and the other related components are previously provided to the door 40, the conventional refrigerator can be easily provided with the ice maker 50 and the dispenser 60 by merely exchanging a conventional door for the door 40. The function of the conventional refrigerator can be easily upgraded.

In the meantime, water is supplied to the filter 70 through the water supply tube 80 which passes through the lower hinge 47 and connects the door 40 with the outside of the refrigerator 30. The water is purified in the filter 70, and the purified water is then transferred to the ice maker 50 and the dispenser 60 under the control of the valve 75.

The water transferred into the ice maker 50 is made into ice. Then, the ice is temporarily stored in the ice storage bin 52. At this time, the ice made in the ice maker 50 will be selectively delivered into the ice storage bin 52 by causing the sensor 53 to detect the amount of ice stored in the ice storage bin 52.

The ice stored in the ice storage bin 52 is discharged through the ice outlet 65 of the dispenser 60 whenever dispensing signals are transmitted to the dispenser 60. At this time, the ice moving mechanism 55 causes the ice to move by means of the motor 59. The ice is crushed or cracked by the ice crusher 56, and then supplied to the ice outlet 65.

In addition, water is released from the dispenser 60 by causing the user to push the opening lever 62 with the cup or other containers. That is, when the opening lever 62 is pushed, the valve 75 is opened to allow the connection tube 82 and the supply tube 86 to communicate with each other so that the water can be supplied to the dispenser 60. The water transferred to the supply tube 86 is discharged to the cup or other containers of the user through the discharge port 63.

Furthermore, the filter 70 should be replaced periodically. That is, in order to replace the filter 70, the service door 72 is opened so that the filter chamber 71 can be seen from the front of the door 40. Then, the filter 70 is exchanged. At this time, the water source, e.g. a water facet, connected to the water supply tube 80 should be first turned off, and the filter 70 should be then exchanged. In the embodiment shown in FIG. 5, after the cutoff valve 95 is operated to close the water supply tube 80, the filter 70 may be exchanged. Therefore, the filter 70 can be replaced more easily from the refrigerator according to the embodiment shown in FIG. 5.

Then, according to the embodiment shown in FIG. 6, the water basin 97 may be simply removed so as to exchange the filter 70. When the water receptacle 97 is removed, the top portion of the filter chamber 71 is opened so that the filter 70 is also exposed. After the filter 70 has been exchanged, the water basin 97 can be simply positioned in place. Therefore, according to the embodiment shown in FIG. 6, the external appearance of the refrigerator door 40 can be more stylish.

In the embodiment shown in FIG. 4, the water supply tank 90 is influenced by cold air in the storage space 33, i.e. the freezing chamber of the refrigerator, which is selectively opened and closed by the door 40. Thus, the water stored in the water supply tank 90 is kept at a relatively low temperature, so that the relatively cold water can be released from the dispenser 60 and supplied to the user.

As specifically described above, the refrigerator according to the present invention is configured in such a manner that the ice maker, the dispenser and the related components are installed to the door capable of selectively opening and closing the storage space of the main body of the refrigerator. Accordingly, the functions of the dispenser and the ice maker can be added to the conventional refrigerator by merely exchanging a conventional door for the door with the dispenser and ice maker. Thus, the function of the conventional refrigerator can be easily upgraded. Further, the main bodies of the refrigerators can be commonly produced and used in both models with and without the dispenser and ice maker. Thus, there is an advantage in that costs of production can be reduced.

In addition, since the dispenser, the ice maker, the filter, the valve, and the like are installed adjacent to one another, the configurations for connecting the components with one another can be simplified and do not occupy the storage space in the main body of the refrigerator. Therefore, there is another advantage in that the storage space can be relatively increased.

Further, according to the present invention, the filter is installed to the door of the refrigerator, and the filter chamber in which the filter is installed can be opened and closed by the service door. Thus, the filter can be exchanged more easily. Moreover, the external appearance of the refrigerator door can be more improved by using the water basin for opening and closing the filter chamber.

Furthermore, the water supplied to the dispenser is temporarily stored in the water supply tank in which heat exchange with the freezing chamber can be made. Therefore, there is also an advantage in that the temperature of the water released from the dispenser can be relatively lowered so that the user can drink the cold water.

Although the present invention has been described in connection with the preferred embodiments. It will be apparent to those skilled in the art that various changes and modifications can be made thereto without departing from the scope and spirit of the present invention. Therefore, the embodiments should be considered as not restrictive but illustrative. Further, the true scope of the present invention is defined by the appended claims, and changes and modifications should be constructed as falling within the scope of the present invention.

What is claimed is:

1. A refrigerator, comprising:

a main body with a storage space defined thereby;

a door installed to the main body of the refrigerator for selectively opening and closing the storage space;

a water filter mounted in the door for purifying water supplied from the outside of the main body of the refrigerator;

a dispenser formed in front of the door for discharging the water purified in the filter to the outside of the main body of the refrigerator; and an ice maker mounted in the door for making the water into ice, wherein the filter is mounted in a filter chamber formed in the door.

2. The refrigerator as claimed in claim 1, wherein the filter is supplied with the water from an outside water source through a water supply tube that passes through a door hinge and extends through the door of the refrigerator.

3. The refrigerator as claimed in claim 1, wherein a service door is provided in the filter chamber for selectively opening and closing the filter chamber.

4. The refrigerator as claimed in claim 1, wherein a motor for driving the ice maker is further provided in the filter chamber.

5. The refrigerator as claimed in claim 1, wherein the filter chamber is selectively opened and closed by a water basin that is provided below the dispenser.

6. The refrigerator as claimed in claim 5, wherein a water supply tank in which heat exchange with cold air in the storage space is made is further provided in a supply tube to the dispenser through which the water purified in the filter is supplied to the dispenser.

7. The refrigerator as claimed in claim 6, wherein a cutoff means for cutting off the water flowing toward the filter upon exchange of the filter is further provided at a water supply tube through which the water is supplied from the outside source to the filter.

8. A refrigerator door for opening and closing a storage space defined by a main body of a refrigerator, comprising:

a water filter mounted in the door for purifying water supplied from the outside of the main body of the refrigerator;

a dispenser for discharging the water purified in the filter to the outside of the refrigerator through an exterior surface of the door; and an ice maker mounted in the door for making the water into ice, wherein the filter is mounted in a filter chamber formed in the door.

9. The refrigerator door as claimed in claim 8, wherein the filter is supplied with the water from an outside water source through a water supply tube that passes through a door hinge and extends through the door of the refrigerator.

10. The refrigerator door as claimed in claim 8, wherein a service door is provided in the filter chamber for selectively opening and closing the filter chamber.

11. The refrigerator door as claimed in claim 9, wherein a motor for driving the ice maker and a valve for regulating water supply to the ice maker and dispenser are further provided in the filter chamber.

12. The refrigerator door as claimed in claim 8, wherein the filter chamber is selectively opened and closed by a water basin that is provided below the dispenser.

13. The refrigerator door as claimed in claim 12, wherein a water supply tank in which heat exchange with cold air in the storage space is made is further provided in a supply tube to the dispenser through which the water purified in the filter is supplied to the dispenser.

14. A refrigerator, comprising:

a main body with a storage space defined thereby;

a door installed to the main body of the refrigerator for selectively opening and closing the storage space;

a water filter mounted in the door for purifying water supplied from the outside of the main body of the refrigerator;

a dispenser formed in front of the door for discharging the water purified in the filter to the outside of the main body of the refrigerator; and an ice maker mounted in the door for making the water into ice, wherein the filter is mounted in a filter chamber, and the filter chamber is selectively opened and closed by a water basin that is provided below the dispenser.

15. The refrigerator as claimed in claim 14, wherein the filter is supplied with the water from an outside water source through a water supply tube that passes through a door hinge and extends through the door of the refrigerator.

16. The refrigerator as claimed in claim 14, wherein a service door is provided in the filter chamber for selectively opening and closing the filter chamber.

17. The refrigerator as claimed in claim 14, wherein a water supply tank in which heat exchange with cold air in the storage space is made is further provided in a supply tube to the dispenser through which the water purified in the filter is supplied to the dispenser.

18. The refrigerator as claimed in claim 17, wherein a cutoff device for cutting off the water flowing toward the filter upon exchange of the filter is further provided at a water supply tube through which the water is supplied from the outside source to the filter.

19. A refrigerator door for opening and closing a storage space defined by a main body of a refrigerator, comprising:

a water filter mounted in the door for purifying water supplied from the outside of the main body of the refrigerator;

a dispenser for discharging the water purified in the filter to the outside of the refrigerator through an exterior surface of the door; and an ice maker mounted in the door for making the water into ice, wherein the filter is mounted in a filter chamber, and the filter chamber is selectively opened and closed by a water basin that is provided below the dispenser.

20. The refrigerator door as claimed in claim 19, wherein the filter is supplied with the water from an outside water source through a water supply tube that passes through a door hinge and extends through the door of the refrigerator.

21. The refrigerator door as claimed in claim 19, wherein a service door is provided in the filter chamber for selectively opening and closing the filter chamber.

22. The refrigerator door as claimed in claim 19, wherein a water supply tank in which heat exchange with cold air in the storage space is made is further provided in a supply tube to the dispenser through which the water purified in the filter is supplied to the dispenser.

23. The refrigerator as claimed in claim 1, wherein a valve for regulating water supply to the ice maker and dispenser is further provided in the filter chamber.

24. A refrigerator, comprising:

a main body with a storage space defined thereby;

a door installed to the main body of the refrigerator for selectively opening and closing the storage space;

a water filter mounted in a filter chamber formed in the door for purifying water supplied from the outside of the main body of the refrigerator; and a dispenser formed in front of the door for discharging the water purified in the filter to the outside of the main body of the refrigerator.

25. The refrigerator as claimed in claim 24, wherein the filter is supplied with the water from an outside water source through a water supply tube that passes through a door hinge and extends through the door of the refrigerator.

26. The refrigerator as claimed in claim 24, wherein a service door is provided in the filter chamber for selectively opening and closing the filter chamber.

27. The refrigerator as claimed in claim 24, further comprising an ice maker mounted in the door for making the water into ice, wherein a motor for driving the ice maker is further provided in the filter chamber.

28. The refrigerator as claimed in claim 27, wherein a valve for regulating water supply to the dispenser is further provided in the filter chamber.

29. The refrigerator as claimed in claim 24, wherein the filter chamber is selectively opened and closed by a water basin that is provided below the dispenser.

30. The refrigerator as claimed in claim 25, wherein a water supply tank in which heat exchange with cold air in the storage space is made is further provided in a supply tube to the dispenser through which the water purified in the filter is supplied to the dispenser.

31. The refrigerator as claimed in claim 28, wherein a cutoff device for cutting off the water flowing toward the filter upon exchange of the filter is further provided at a water supply tube through which the water is supplied from the outside source to the filter.

32. A refrigerator, comprising:

a main body with a storage space defined thereby;

a door installed to the main body of the refrigerator for selectively opening and closing the storage space;

a water filter mounted in the door for purifying water supplied from the outside of the main body of the refrigerator; and a valve for regulating water supply to the water filter, wherein an inlet of the water filter is communicated with an outside water source and the outlet of the water filter is communicated with the valve, wherein the filter is mounted within a filter chamber formed in the door and a service door is provided in the filter chamber for selectively opening and closing the filter chamber.

33. The refrigerator as claimed in claim 32, wherein the filter is supplied with the water from an outside water source through a water supply tube that passes through a door hinge and extends through the door of the refrigerator.

34. The refrigerator as claimed in claim 32, wherein a cutoff device for cutting off the water flowing toward the filter upon exchange of the filter is further provided at a water supply tube through which the water is supplied from the outside source to the filter.

35. The refrigerator as claimed in claim 32, wherein the filter chamber is selectively opened and closed by a water basin that is provided below an dispenser.

36. The refrigerator as claimed in claim 35, wherein a water supply tank in which heat exchange with cold air in the storage space is made is further provided in a supply tube to the dispenser through which the water purified in the filter is supplied to the dispenser.

* * * * *